US008418870B2

(12) United States Patent
Song

(10) Patent No.: US 8,418,870 B2
(45) Date of Patent: Apr. 16, 2013

(54) COVER FOR PRESERVATION CONTAINER

(76) Inventor: Xubin Song, Guangdong (CN)

( * ) Notice: Subject to any disclaimer, the term of this patent is extended or adjusted under 35 U.S.C. 154(b) by 699 days.

(21) Appl. No.: 12/322,806

(22) Filed: Feb. 6, 2009

(65) Prior Publication Data

US 2009/0223986 A1 Sep. 10, 2009

(30) Foreign Application Priority Data

Feb. 10, 2008 (CN) ..... 2008 1 0026338
Aug. 3, 2008 (CN) ..... 2008 1 0029978

(51) Int. Cl.
*B65D 45/02* (2006.01)
*B65D 45/16* (2006.01)

(52) U.S. Cl.
USPC ..... 220/319; 220/287; 220/324; 220/783; 220/795; 220/806; 215/274; 215/349; 215/350; 215/352

(58) Field of Classification Search ..... 220/231, 220/287, 315, 319, 320, 324, 326, 783, 792, 220/795, 495.02, 495.06, 495.08, 495.11, 220/695, 806; 215/319, 341, 349–351, 252, 215/274
See application file for complete search history.

(56) References Cited

U.S. PATENT DOCUMENTS 606,838 A * 7/1898 Heins ..... 220/797
803,932 A * 11/1905 Smelker ..... 215/276
826,215 A * 7/1906 Allyn ..... 220/783
929,842 A * 8/1909 Eckart ..... 220/521
1,239,183 A * 9/1917 Hodgson ..... 220/256.1
1,277,724 A * 9/1918 Hodgson ..... 220/256.1
1,632,031 A * 6/1927 Mauser ..... 220/320
1,847,245 A * 3/1932 Hothersall ..... 220/319
1,857,853 A * 5/1932 McMann ..... 215/321
1,955,610 A * 4/1934 Seipt ..... 220/8
2,065,293 A * 12/1936 Scudder ..... 220/495.11
2,154,741 A * 4/1939 Gray ..... 220/8
2,591,482 A * 4/1952 Weltlich ..... 220/700
2,652,148 A * 9/1953 Pfeifer ..... 206/568
2,751,073 A * 6/1956 Sheeran ..... 206/216
2,844,277 A * 7/1958 Wagner ..... 220/319
2,885,107 A * 5/1959 Bliss ..... 220/592.2
2,893,456 A * 7/1959 Wallace ..... 215/274
2,912,136 A * 11/1959 Redmond et al. ..... 206/524.5
3,052,371 A * 9/1962 Van Bemmelen ..... 220/530
3,204,813 A * 9/1965 McCuskey et al. ..... 220/792

(Continued)

FOREIGN PATENT DOCUMENTS

CA 552834 A * 2/1958
EP 383745 A1 * 8/1990

(Continued)

*Primary Examiner* — J. Gregory Pickett
*Assistant Examiner* — Ned A Walker
(74) *Attorney, Agent, or Firm* — Raymond Y. Chan; David and Raymond Patent Firm

(57) ABSTRACT

A preservation container cover includes a flexible film to contact with the rim of the container, an upper sealing ring, and a lower sealing ring affixing a periphery portion of the flexible film. The upper sealing ring has a ring slot extending along the periphery portion of the flexible film. The lower sealing ring comprises a ring plug along the periphery portion of the flexible film. The ring slot and the ring plug form a clamp structure to affix the flexible film. The present invention is convenient to use, adaptable to various containers of different types and sizes, and won't cause waste of natural resources and environment problems.

2 Claims, 10 Drawing Sheets

U.S. PATENT DOCUMENTS 3,235,114 A * 2/1966 Blackwood et al. ..... 215/350
3,298,561 A * 1/1967 McConnie ..... 220/695
3,307,728 A * 3/1967 Elser ..... 215/276
3,373,893 A * 3/1968 Dunkelis ..... 220/222
3,417,895 A * 12/1968 Penton ..... 220/522
3,443,735 A * 5/1969 Meijers ..... 229/117.27
3,511,990 A * 5/1970 Hauss ..... 378/187
3,520,440 A * 7/1970 Kinnavy et al. ..... 220/783
3,523,863 A * 8/1970 Juhos ..... 428/195.1
3,550,808 A * 12/1970 Mounts et al. ..... 206/509
3,566,946 A * 3/1971 Mac Donald ..... 220/783
3,680,731 A * 8/1972 Lelyk et al. ..... 220/319
3,696,561 A * 10/1972 Harp et al. ..... 49/483.1
3,760,969 A * 9/1973 Shimamoto et al. ..... 215/247
3,841,466 A * 10/1974 Hoffman et al. ..... 206/205
3,866,782 A * 2/1975 Westfall ..... 215/253
3,901,405 A * 8/1975 Norberg ..... 220/287
3,907,158 A * 9/1975 Frankenberg ..... 220/269
3,930,589 A * 1/1976 Koontz ..... 215/352
3,933,267 A * 1/1976 Rohde ..... 215/350
4,044,941 A * 8/1977 Knudsen ..... 220/258.3
4,055,270 A * 10/1977 Underwood ..... 220/522
4,091,961 A * 5/1978 DuBois et al. ..... 220/319
4,094,460 A * 6/1978 Scanga et al. ..... 229/123.1
4,109,815 A * 8/1978 Collins, III ..... 215/232
4,111,330 A * 9/1978 Jordan ..... 220/319
4,124,141 A * 11/1978 Armentrout et al. ..... 220/783
4,125,210 A * 11/1978 Embree ..... 222/570
4,154,360 A * 5/1979 Smith ..... 220/258.3
4,169,568 A * 10/1979 Drew et al. ..... 244/148
4,218,967 A * 8/1980 Batchelor ..... 99/472
4,252,265 A * 2/1981 Brundige et al. ..... 229/5.7
4,298,134 A * 11/1981 Lewis, Jr. ..... 220/792
4,321,922 A * 3/1982 Deaton ..... 604/319
4,379,455 A * 4/1983 Deaton ..... 604/320
4,419,093 A * 12/1983 Deaton ..... 604/540
4,430,084 A * 2/1984 Deaton ..... 604/317
4,448,311 A * 5/1984 Houser ..... 206/527
4,459,793 A * 7/1984 Zenger ..... 53/434
4,466,553 A * 8/1984 Zenger ..... 220/495.08
4,553,679 A * 11/1985 Hatakeyama et al. ..... 215/232
4,625,883 A * 12/1986 Burke et al. ..... 220/578
4,689,099 A * 8/1987 Ito et al. ..... 156/69
4,698,210 A * 10/1987 Solazzi ..... 356/246
4,705,183 A * 11/1987 Moloney ..... 215/276
4,728,003 A * 3/1988 Davey ..... 220/319
4,741,174 A * 5/1988 Uesaka ..... 62/342
4,747,500 A * 5/1988 Gach et al. ..... 215/250
4,813,561 A * 3/1989 Ochs ..... 215/252
4,880,127 A * 11/1989 Doi ..... 215/252
4,896,782 A * 1/1990 Hawkins et al. ..... 215/329
4,930,636 A * 6/1990 Meadows ..... 206/503
4,932,554 A * 6/1990 Smith et al. ..... 220/319
4,934,558 A * 6/1990 Vargas ..... 220/287
4,974,244 A * 11/1990 Torrisi et al. ..... 378/45
4,984,688 A * 1/1991 Mikulin ..... 206/455
4,993,577 A * 2/1991 Griffin et al. ..... 220/258.5
5,052,568 A * 10/1991 Simon ..... 215/250
5,078,290 A * 1/1992 Ochs ..... 215/276
5,118,003 A * 6/1992 Pepper et al. ..... 220/495.08
5,123,573 A * 6/1992 Kucherer ..... 222/325
5,161,689 A * 11/1992 Balson ..... 206/509
5,165,562 A * 11/1992 Raney ..... 220/783
5,193,705 A * 3/1993 McCallum et al. ..... 220/319
5,232,117 A * 8/1993 Hale ..... 220/495.08
5,253,280 A * 10/1993 Mizuta ..... 378/45
5,259,526 A * 11/1993 Stolzman ..... 220/802
5,320,243 A * 6/1994 Hale ..... 220/495.01
5,323,441 A * 6/1994 Torrisi et al. ..... 378/44
5,330,068 A * 7/1994 Duhaime et al. ..... 220/304
5,341,949 A * 8/1994 Hayes ..... 215/253
5,407,077 A * 4/1995 Sinclair, Sr ..... 206/586
5,421,473 A * 6/1995 McCrossen ..... 220/319
5,465,863 A * 11/1995 Seick et al. ..... 220/495.01
5,476,187 A * 12/1995 Marisco ..... 220/495.08
5,503,701 A * 4/1996 Seick et al. ..... 156/247
5,662,238 A * 9/1997 Sarno ..... 220/495.11
5,692,635 A * 12/1997 Farrell et al. ..... 220/270
5,703,927 A * 12/1997 Torrisi et al. ..... 378/208
5,707,823 A * 1/1998 Carr et al. ..... 435/29
5,785,198 A * 7/1998 Credle, Jr. ..... 220/254.8
5,803,298 A * 9/1998 Hausmann ..... 220/319
5,813,529 A * 9/1998 Goserud ..... 206/315.1
5,865,335 A * 2/1999 Farrell et al. ..... 220/270
5,915,557 A * 6/1999 Levine ..... 206/509
5,950,638 A * 9/1999 Crosta ..... 132/293
5,967,363 A * 10/1999 Allen ..... 220/806
5,974,686 A * 11/1999 Nomura et al. ..... 34/263
6,035,769 A * 3/2000 Nomura et al. ..... 99/472
6,105,807 A * 8/2000 McCrossen ..... 220/288
6,142,330 A * 11/2000 Sacks ..... 220/23.6
6,234,338 B1 * 5/2001 Searle ..... 220/366.1
6,293,286 B1 * 9/2001 Gueret ..... 132/299
6,349,654 B1 * 2/2002 Peters ..... 108/26
6,491,185 B1 * 12/2002 Azzarello et al. ..... 220/783
6,603,544 B1 * 8/2003 Eckert ..... 356/246
6,874,647 B2 * 4/2005 Bloom et al. ..... 215/276
6,910,623 B2 * 6/2005 Stewart et al. ..... 229/125.19
7,014,060 B2 * 3/2006 Richardson ..... 220/288
7,086,545 B2 * 8/2006 Mannion et al. ..... 211/181.1
7,147,118 B2 * 12/2006 Bloom et al. ..... 215/276
7,175,039 B2 * 2/2007 German et al. ..... 215/252
7,594,586 B2 * 9/2009 Cai ..... 220/287
7,611,026 B1 * 11/2009 Bloom et al. ..... 215/276
7,617,946 B2 * 11/2009 Loerop et al. ..... 220/319
7,624,891 B2 * 12/2009 Appelbaum et al. ..... 220/326
7,703,626 B2 * 4/2010 Witt ..... 220/276
7,722,821 B2 * 5/2010 Solazzi ..... 422/547
7,784,629 B2 * 8/2010 German et al. ..... 215/276
8,038,026 B2 * 10/2011 Auer et al. ..... 220/326
8,043,862 B2 * 10/2011 Solazzi ..... 436/172
8,105,638 B2 * 1/2012 Harlfinger ..... 426/106
2002/0162846 A1 * 11/2002 Mercier ..... 220/780
2003/0141311 A1 * 7/2003 Ceolin et al. ..... 220/701
2004/0108294 A1 * 6/2004 Bloom et al. ..... 215/276
2004/0232150 A1 * 11/2004 John P. et al. ..... 220/319
2006/0060584 A1 * 3/2006 Onoda ..... 220/287
2006/0104867 A1 * 5/2006 Solazzi ..... 422/102
2006/0201946 A1 * 9/2006 Witt ..... 220/276
2006/0278651 A1 * 12/2006 Appelbaum et al. ..... 220/784
2007/0023434 A1 * 2/2007 Kim ..... 220/315
2007/0131701 A1 * 6/2007 Herbert et al. ..... 220/826
2008/0041852 A1 * 2/2008 Cai ..... 220/231
2008/0169287 A1 * 7/2008 Auer et al. ..... 220/287
2010/0127003 A1 * 5/2010 Alvares et al. ..... 220/669
2010/0226827 A1 * 9/2010 Solazzi ..... 422/102
2011/0051134 A1 * 3/2011 Solazzi ..... 356/300

FOREIGN PATENT DOCUMENTS

EP 535383 A2 * 4/1993
EP 1332976 A1 * 8/2003
FR 1362620 A * 6/1964
FR 2104677 A1 * 4/1972

* cited by examiner

COVER FOR PRESERVATION CONTAINER

BACKGROUND OF THE PRESENT INVENTION

1. Field of Invention

The present invention relates to a cover for preservation containers, and more particularly to a preservation container cover which is flexible to preservation containers of different sizes and types.

2. Description of Related Arts

It is well known that the cover of a preservation container must fit the opening of the preservation container. Therefore, for a plurality of containers with different sizes, each of the containers must be provided with a specific cover correspondingly to prevent leaking. In other words, each kind of containers must use its own cover.

However, there are many containers that do not have their own covers. For these containers, different methods for preventing leakage of the food stored therein are used. For example, ethylene resin wrap is widely used in restaurants and families to seal bowls or other containers to prevent the food contained therein, such as hot soup, from leaking In fact, the wrap or cling film for packing is a disposable product that results a great unnecessary waste to natural resources. Additionally, the wrap is easy to be broken, so a large amount is needed to wrap firmly. Other problems include the hot soup in the container can easily break the wrap and the wrap is not easy to remove after heated.

In addition, the packing wrap is merely for one-time used, producing large quantities of waste. This waste is not easy to degrade and causes serious environmental problems.

SUMMARY OF THE PRESENT INVENTION

According to the problems mentioned above, an object of the present invention is to provide a preservation container cover which is convenient to use, suitable for various containers of different types and sizes, and avoids the wasting of natural resources and environmental problems.

To accomplish the above object, the present invention provides a preservation container cover, comprising a flexible film to contact with a rim of a container, an upper sealing ring, and a lower sealing ring affixing a periphery of the flexible film.

In one embodiment of the present invention, the upper sealing ring has a ring slot along the periphery of the flexible film, the lower sealing ring comprises a ring plug along the periphery of the flexible film, and the ring slot and the ring plug form a clamp structure to affix the flexible film.

In the present invention, the upper sealing ring, the flexible film, and the lower sealing ring are rigidly connected by fusing to form a firm and reliable connection.

In the present invention, the upper sealing ring comprises an upper shoulder corresponding to the edge of the flexible film and the lower sealing ring comprises a lower shoulder corresponding to the edge of the flexible film, wherein the upper shoulder and the lower shoulder form a clamp structure to affix the edge of the flexible film.

In the present invention, the lower shoulder of the lower sealing ring has a slot, wherein a bottom sealing ring is embedded in the slot and the extruding portion of the lower bottom sealing ring forms an expanding element of the lower shoulder of the lower sealing ring.

In the present invention, the flexible film comprises an extending portion extending outwardly from the rim of the container and extending portion forming a vacuum releasing structure of the flexible film which is used to release the vacuum after a vacuum sealing the container.

In the present invention, the upper sealing ring comprises a handle at the position of the extending portion of the flexible film, wherein the handle is corresponding to the vacuum releasing element for applying an upward force to the vacuum releasing element of the flexible film to release the vacuum.

In the present invention, the flexible film is made of thermoplastic material.

In the present invention, the thermoplastic material is selected from the group consisting of polycarbonate, polyethylene, polyvinylidene chloride, or propylene which is nontoxic to human body.

The advantages of the present invention include the following:

1) The preservation container cover has no limitation to the type and size of the container.

2) The cover can conveniently seal the container by vacuum and be removed from the container.

3) Unlike the wrap, the cover of the present invention can be reused and won't cause wasting natural resources and environmental problems.

4) The container sealed by the cover of the present invention can be heated by microwave directly and conveniently to cook or heat the stuff inside the container.

Accordingly, the present invention is convenient to use, adaptable to containers of different types and sizes, and won't cause resource wasting and environment problems.

In one embodiment, the present invention provides a preservation container cover which comprises a flexible film to contact with an upper rim of a container, an upper ring, and a lower ring adapted to affix a periphery of the flexible film. The upper ring comprises an inner block ring and an outer block ring, wherein the inner block ring and the outer block ring form a clamp ring which has an opening thereof facing downward and a cross section having a "U" shape. The lower ring comprises an inner expanding ring and an outer expanding ring. The inner expanding ring and the outer expanding ring form an expanding ring with an opening thereof facing upward, wherein a cross section of the expanding ring is in a "U" shape. The opening of the clamp ring and the opening of the expanding ring are facing each other and coupled by clamping and expanding which affixes the periphery of the flexible film. Because of the coupling between the clamp ring and the expanding ring with the "U" shape cross section, the problems of the conventional two rings structure, such as loose sealing of the periphery of the flexible film and sliding of the flexible film, are solved.

In an alternative mode of the present invention, the inner expanding ring comprises a shoulder corresponding to the press surface of the inner block ring. The shoulder further comprises a conical ring integrally extended from the shoulder wherein the conical ring is plugged into the inner wall of the inner block ring. The shoulder and the press surface provide a vertical pressure to the periphery of the flexible film, and the conical ring provides an inner tilt pressure to the periphery of the flexible film.

In the present invention, the outer expanding ring comprises a conical expander which further provides an outer tilt pressure to the periphery of the flexible film.

In the present invention, the outer block ring comprises a loop on the inner wall thereof, wherein the loop limits the position of the terminal of the conical expander of the outer expanding ring. Because the loop provides the limit to the terminal of the expander of the conical ring, the expanding ring can be plugged into the opening of the clamp ring and is not easy to be detached.

In the present invention, the handle of the upper ring comprises a date indicator for indicating the preservation period.

In the present invention, the flexible film comprises an extension extending from the rim of the container outwardly. The extension forms the vacuum releasing element for detach the flexible film from the rim of the container after the container is vacuum sealed.

The benefits of the present invention further include the following:

1) Simple structure: the cover only comprises three parts which are the upper ring, the lower ring, and the flexible film. The upper ring and the lower ring are plastic molded.

2) Easy to fabricate: use the upper ring and the lower ring to press the periphery of the flexible film; the clamp ring and the expanding ring act as the affixing component to clamp the flexible film in merely one step.

The opening of the clamp ring and the opening of the expanding ring are facing each other and coupled by clamping and expanding which affixes the periphery of the flexible film. Because of the coupling between the clamp ring and the expanding ring with the "U" shape cross section, the problems of the conventional two rings structure, such as loose sealing of the periphery of the flexible film, and sliding of the flexible film, are solved. It also skips the conventional second step of fusing the two rings structure with the flexible film.

3) Environmentally friendly and durable: not like the disposable one-time used wrap, the present invention can be re-used, and will not cause waste of natural resources and environment problems.

4) Universal application: can be used for different types of containers such as class, ceramic, plastic, metal containers with shape of round or rectangular.

5) High adaptability: can be used for containers with different sizes, shapes, and materials.

6) Easy to operate: push to seal; pull to release; can be operated by one hand.

Therefore, the present invention is simple, easy to fabricate, durable, environment friendly, universally usable, highly adaptable and easy to use. It is adapted to all kinds of preservation containers.

These and other objectives, features, and advantages of the present invention will become apparent from the following detailed description, the accompanying drawings, and the appended claims.

DETAILED DESCRIPTION OF THE PREFERRED EMBODIMENT

Figure 1:
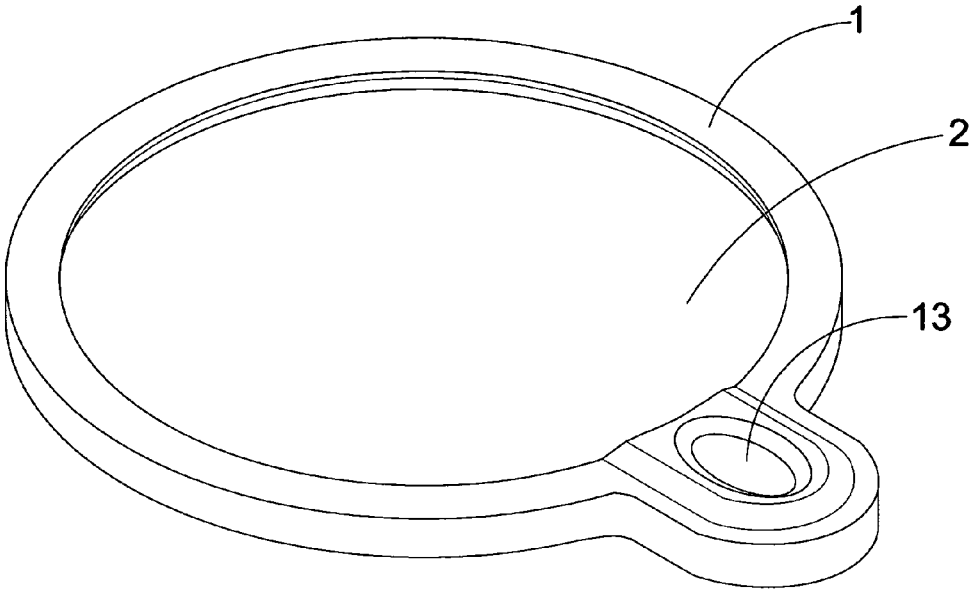
FIG. 1 is a perspective view of an assembled embodiment of the present invention.
Figure 2:
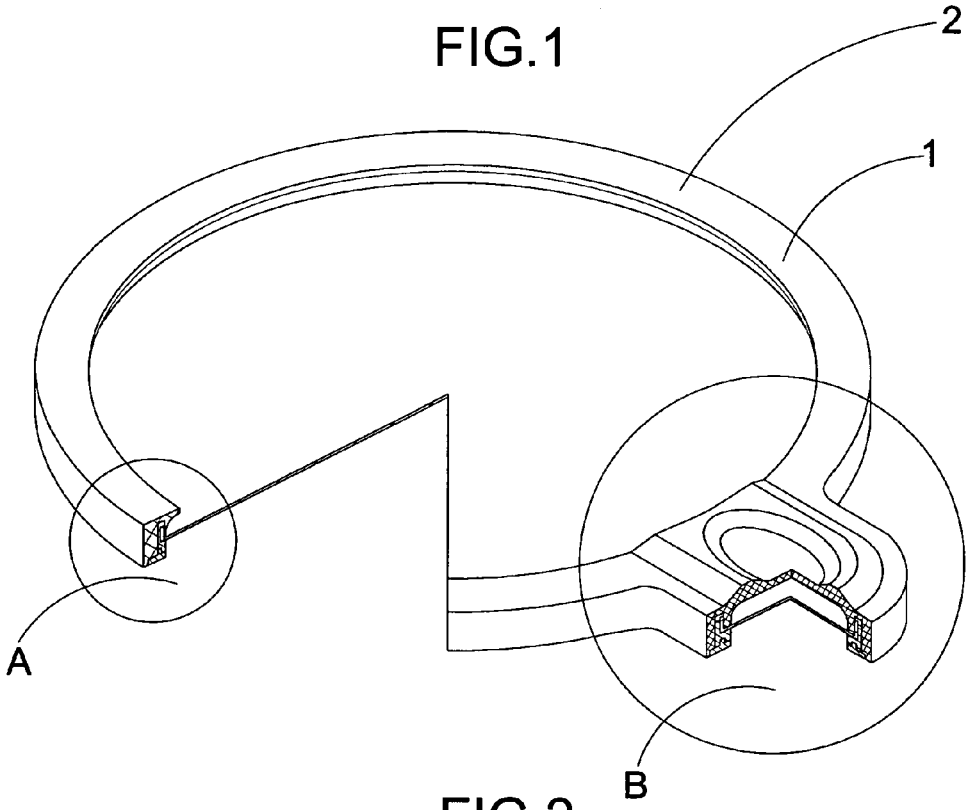
FIG. 2 is a sectional view of an embodiment of the present invention.
Figure 3:
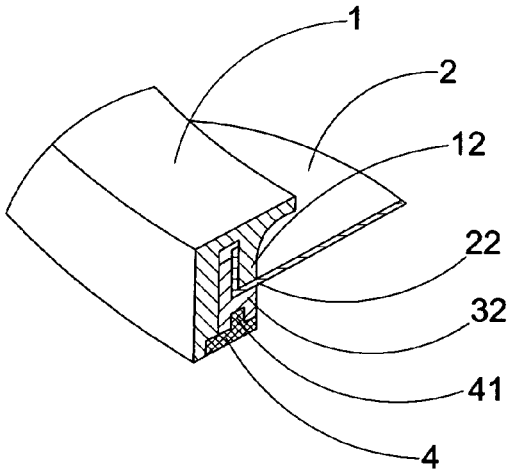
FIG. 3 is an enlarged perspective view of part A of the FIG. 2.
Figure 4:
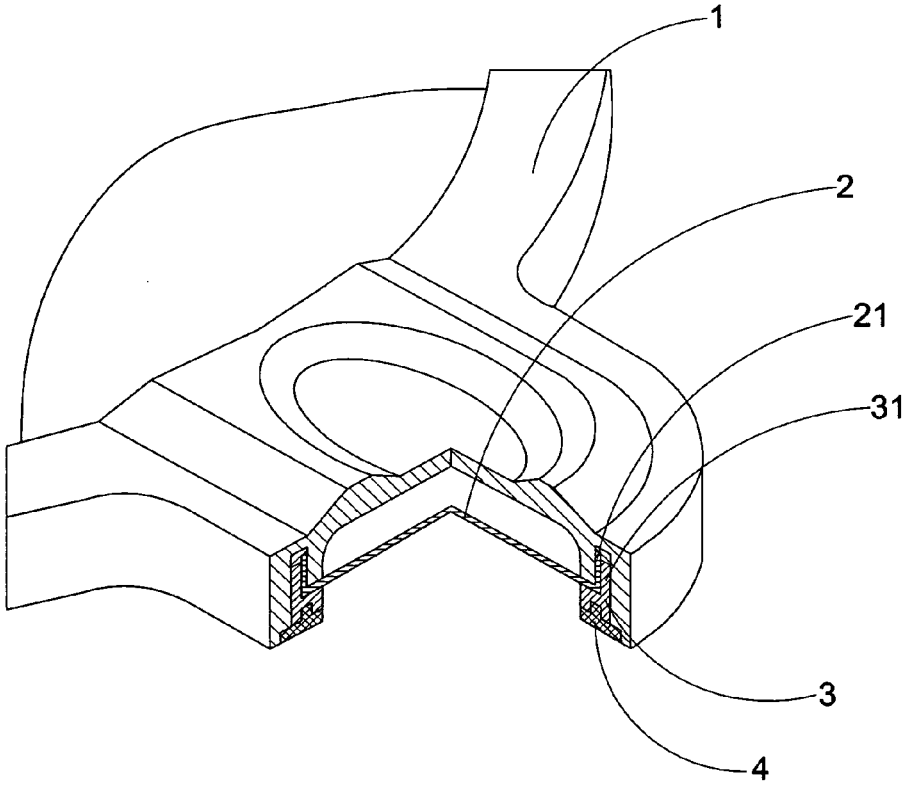
FIG. 4 is an enlarged perspective view of part B of the FIG. 2.
Figure 5:
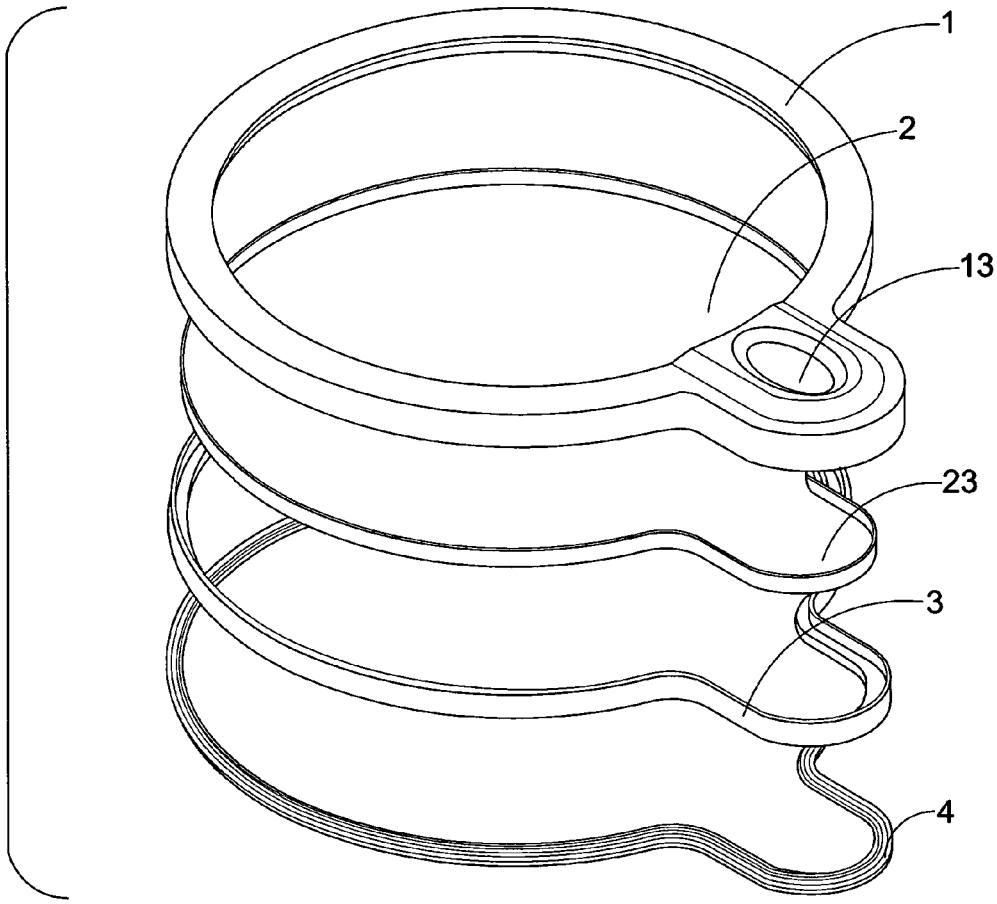
FIG. 5 is a perspective view of separated parts of an embodiment of the present invention.
Figure 6:
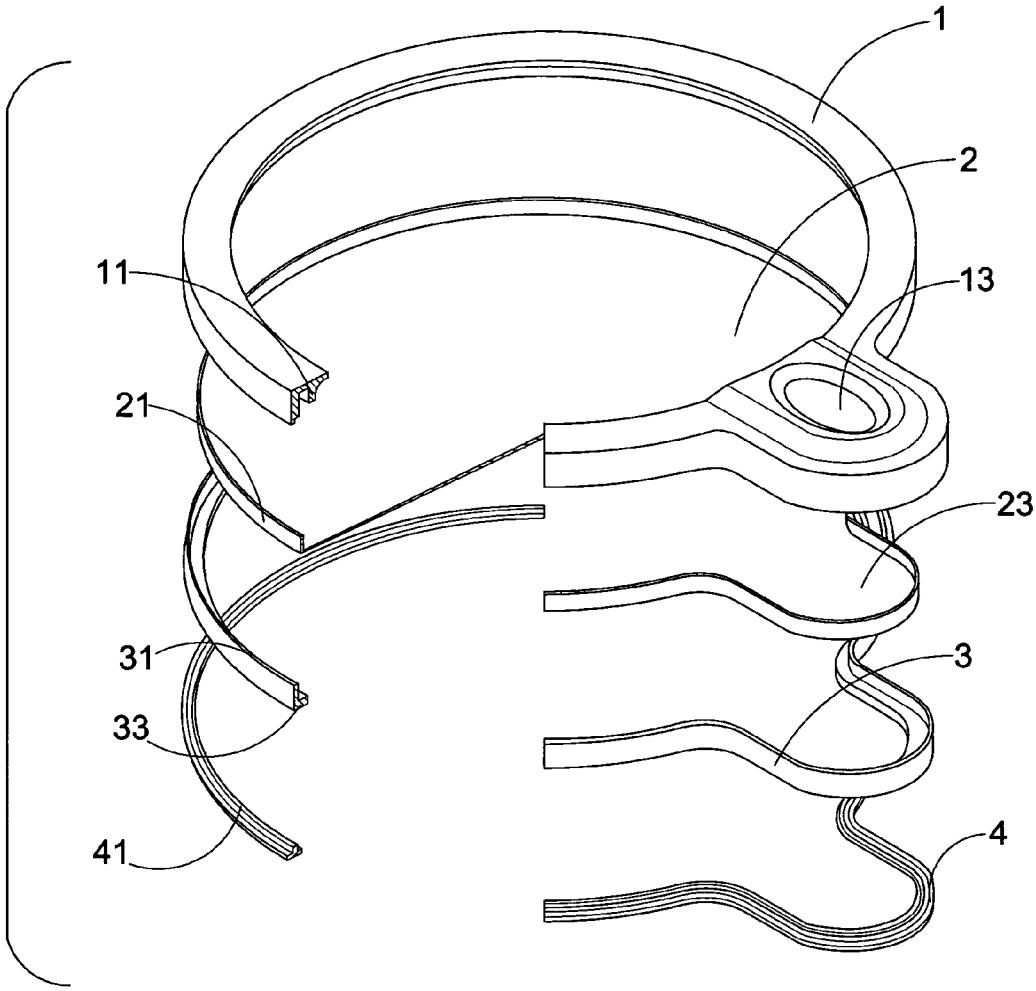
FIG. 6 is a sectional view of the parts in FIG. 5.

Referring to FIGS. 1 to 6, an embodiment of the present invention of a preservation container cover comprises a flexible film 2 adapted to contact with a rim of a container (not shown in Figures), an upper sealing ring 1 and a lower sealing ring 3, wherein the upper sealing ring 1 and the lower sealing ring are adapted to affix a periphery portion 21 of the flexible film 2. The upper sealing ring 1 has a ring slot 11 provided along the periphery portion 21 of the flexible film 2. The lower sealing ring 3 comprises a ring plug 31 extended along the periphery portion 21 of the flexible film 2. The ring slot 11 and the ring plug 31 forms the clamp structure to affix and retain the periphery portion 21 of the flexible film 2 in the ring slot. The upper sealing ring 1, flexible film 2, and the lower sealing ring are firmly and rigidly connected together by fusing. The upper sealing ring 1 comprises an upper shoulder 12 corresponding to an edge portion 22 of the flexible film 2 and the lower sealing ring comprises a lower shoulder 32 corresponding to the edge portion 22 of the flexible film 2, wherein the upper shoulder 12 and the lower shoulder 32 form a clamp construction to affix the edge portion 22 of the flexible film 2 in position. The lower shoulder 32 of the lower sealing ring 3 has an insertion slot 33 provided therearound, wherein a bottom sealing ring 4 is embedded in the insertion slot 33. An extruding portion 41 of the lower bottom sealing ring 4 forms an expanding structure of the lower shoulder 32 of the lower sealing ring 3. The flexible film 2 has an extending portion 23 extending beyond from the rim of the container, the extending portion 23 is constructed as a vacuum releasing element of the flexible film 2 which is used to release the vacuum after vacuum sealing the container. The upper sealing ring 1 comprises a handle 13 with respect to the extending portion 23 of the flexible film 2, so that the handle 13 is able to apply an upward force to the vacuum releasing portion of the flexible film 2 for releasing the vacuum. The flexible film 2 is made of thermoplastic material, selected from a group consisting of polycarbonate, polyethylene, polyvinylidene chloride, and propylene, which is non-toxic to human body.

The operation and principle of the cover of the present invention are described hereinafter. The cover is adapted to be used with all kinds of container, regardless of the types and sizes thereof, as long as the cover is larger than the opening of the container. Vacuum sealing: slightly push down the flexible film 2 of the cover softly that squeezes the air out of the container from its rim, the flexible film 2 and the container are sealed by vacuum. Vacuum releasing: to press the handle 13 with a thumb while pressing the extending portion 23 of the flexible film 2, i.e. the vacuum releasing portion, the air is able to enter into the container while pulling the extending portion 23, so that the vacuum is released and the cover can be removed.

In the present invention, the shape of periphery of the cover can be circular which is close to the shape of the container, or can be oval, rectangular, square, or other polygon. Of course, it can also be other shape which is not mentioned above.

Figure 7:
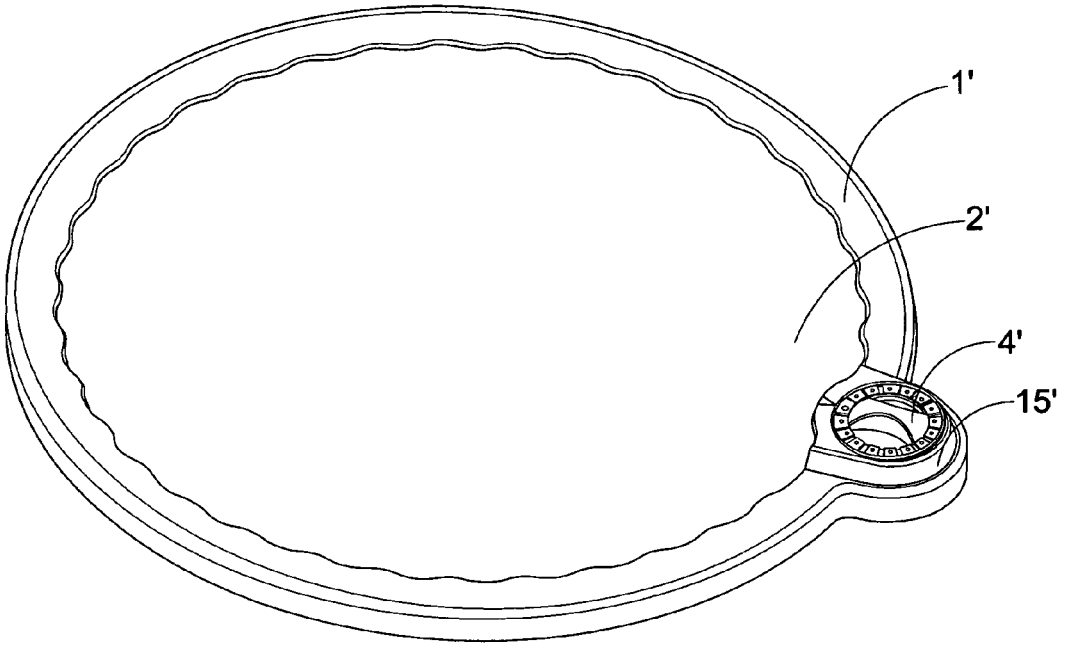
FIG. 7 is a perspective of another embodiment of the present invention.
Figure 8:
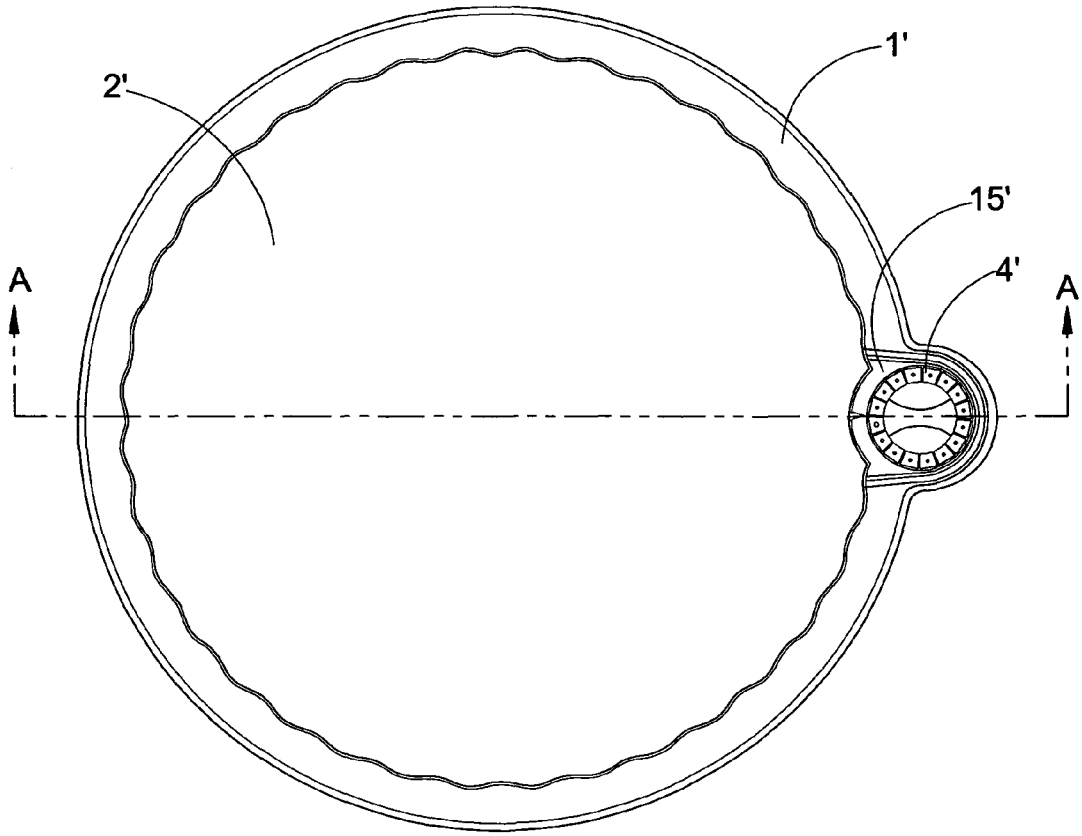
FIG. 8 is a top view of the embodiment in FIG. 7.
Figure 9:
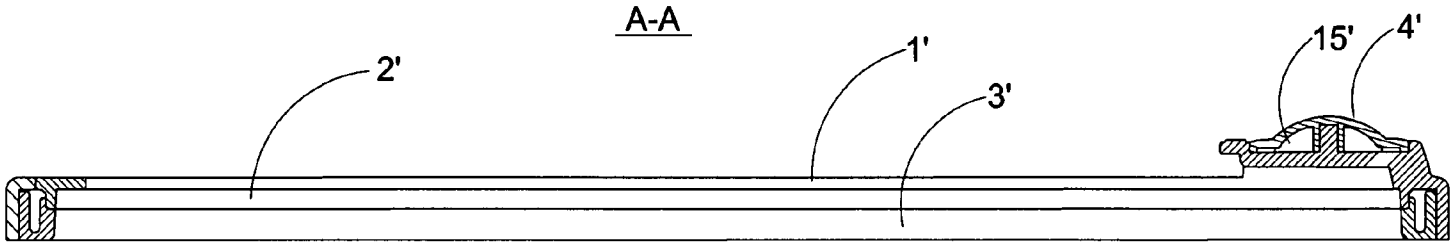
FIG. 9 is a sectional view of the embodiment along the line A-A in FIG. 8.
Figure 10:
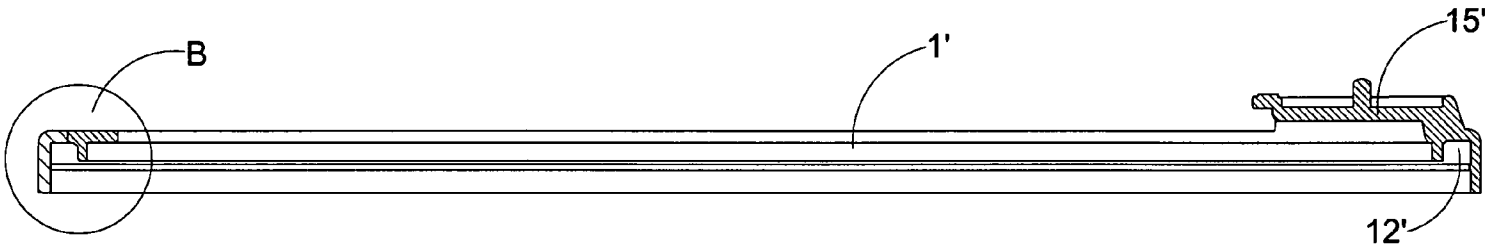
FIG. 10 is a perspective view of the upper ring.
Figure 11:
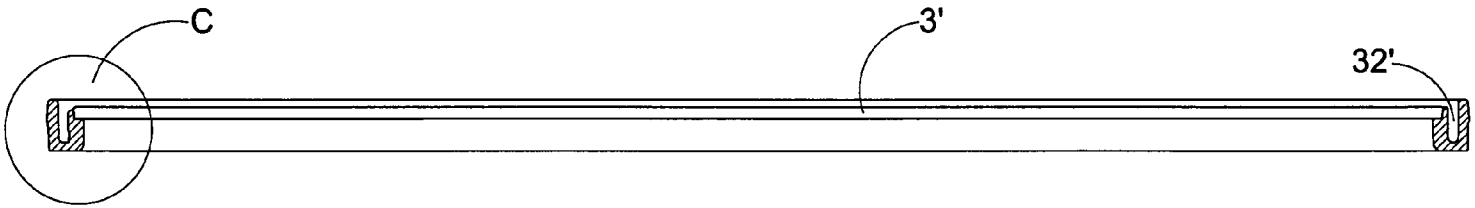
FIG. 11 is a perspective view of the lower ring.
Figure 12:
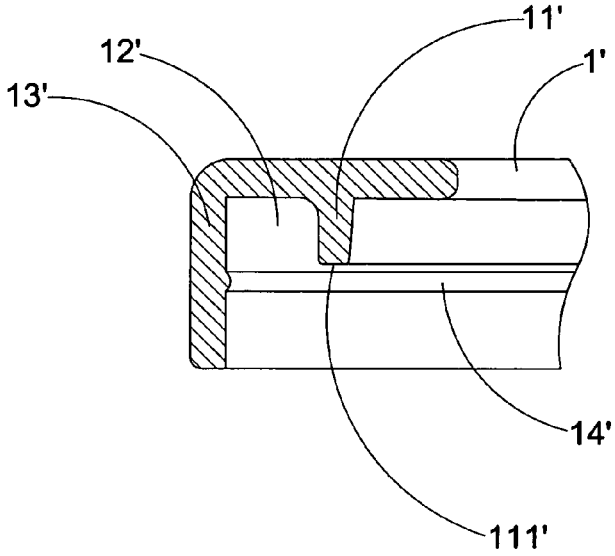
FIG. 12 is an expanded view of the part B in FIG. 10.
Figure 13:
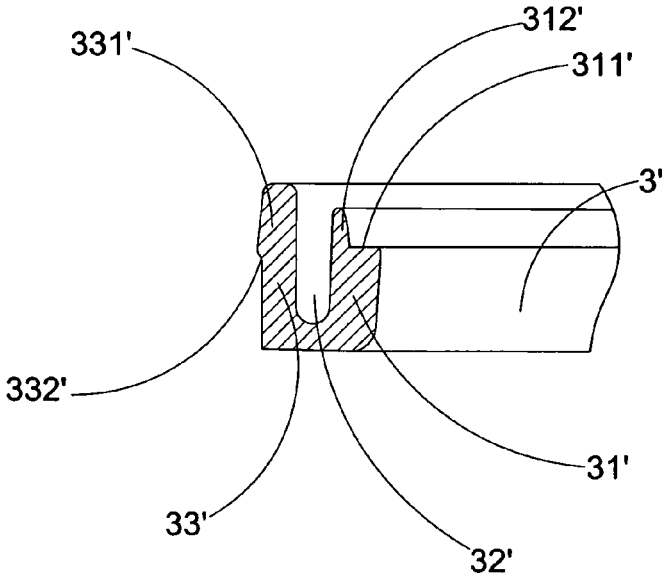
FIG. 13 is an expanded view of the part C in FIG. 11.
Figure 14:
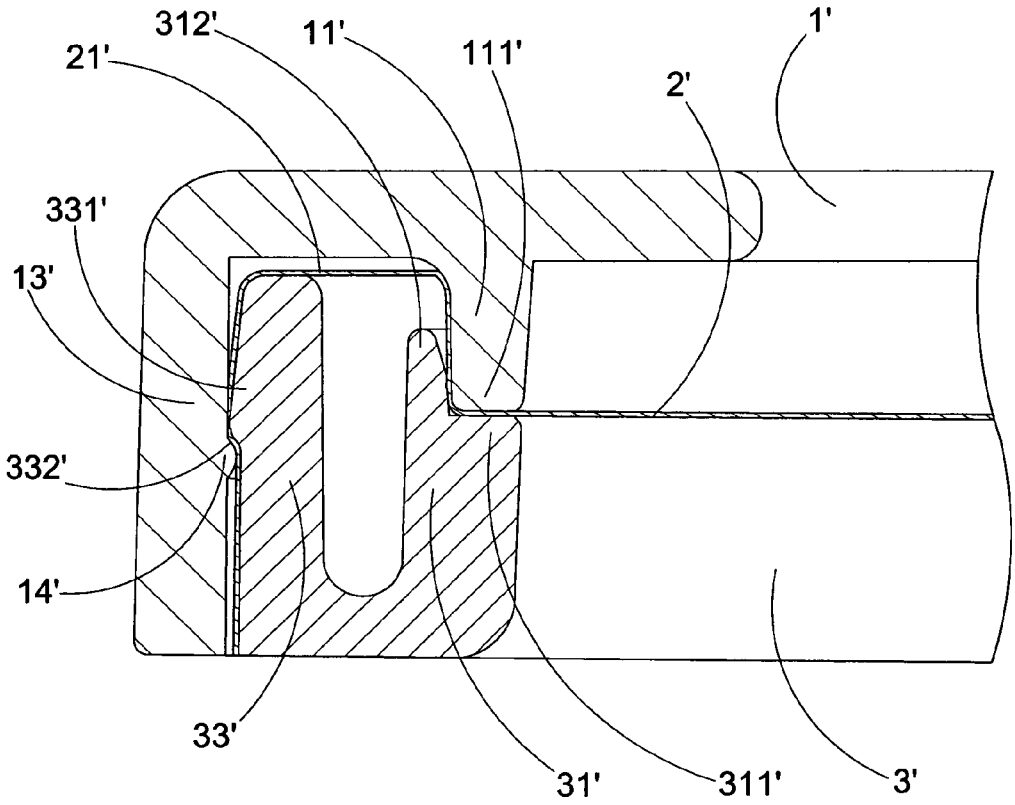
FIG. 14 is a perspective view of the clamp ring and the expanding ring illustrating the affixing of the flexible film.
Figure 15:
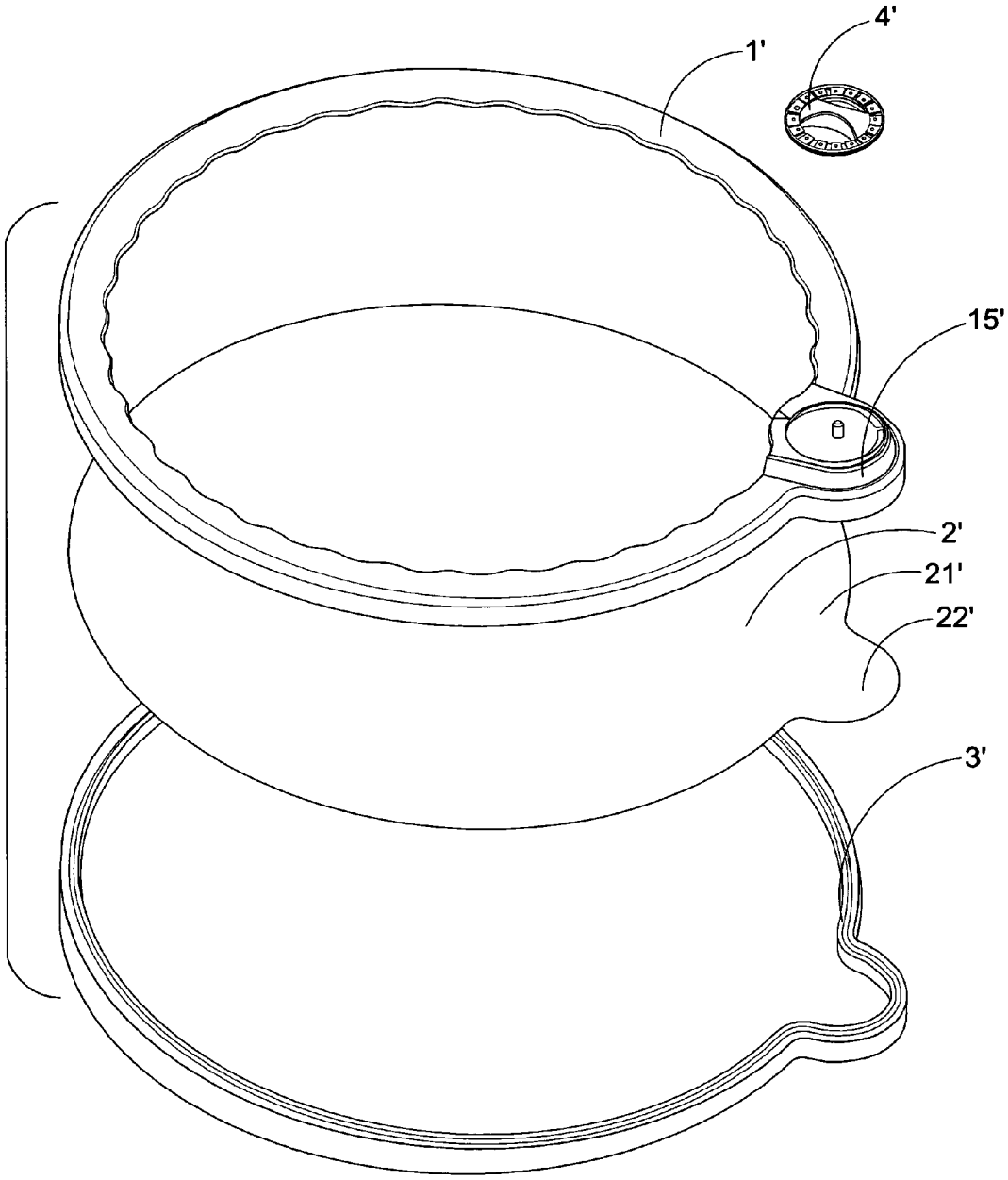
FIG. 15 is a perspective view of the parts in FIG. 7.

Referring to FIGS. 7 to 15, in an alternative embodiment of the present invention, the cover comprises an upper ring 1', a flexible film 2', and a lower ring 3'. The upper ring 1' comprises an inner block ring 11' and an outer block ring 13'. The inner block ring 11' and the outer block ring 13' form a clamp ring 12' with an opening thereof facing downward, wherein a cross section of the clamp ring is in a "U" shape. The lower ring 3' comprises an inner expanding ring 31' and an outer expanding ring 33'. The inner expanding ring 31' and the outer expanding ring 33' form an expanding ring 32' with an opening thereof facing upward, wherein a cross section of the expanding ring 32' is in a "U" shape. The opening of the clamp ring 12' and the opening of the expanding ring 32' are facing each other and coupled by clamping and expanding which affixes the periphery portion 21' of the flexible film 2'. The inner expanding ring 31' comprises a shoulder 311' corresponding to the press surface 111' of the inner block ring 11'. The shoulder 311' further comprises a conical ring 312' integrally extended from the shoulder 311', wherein the conical ring 312' is plugged into the inner wall of the inner block ring 11'. The shoulder 311' and the press surface 111' provide a vertical pressure to the periphery portion 21' of the flexible film 2', and the conical ring 312' provides an inner tilt pressure to the periphery portion 21' of the flexible film 2'. The outer expanding ring 13' comprises a conical expander 331'. The expander 331' further provides an outer tilt pressure to the periphery portion 21' of the flexible film 2'. The outer block ring 13' comprises a loop 14' on the inner wall thereof, wherein the loop 14' limits the position of the terminal 332' of the conical expander 331' of the outer expanding ring 33'. Because the loop 14' provides the limit to the terminal 332' of the conical expander 331' of the outer expanding ring 33', the expanding ring 32' can be plugged into the opening of the clamp ring 12' that is not easy to be detached. The handle 15' of the upper ring 1' comprises a date indicator 4' for indicating the preservation period. The flexible film 2' comprises an extending portion 22' extending beyond the rim of the container outwardly. The extending portion 22' forms a vacuum releasing element for detaching the flexible film 2' from the rim of the container after the container is vacuum sealed.

In the present invention, the flexible film 2' is generally made of high-quality polymeric materials such as polystyrene.

The operation and principle of the cover of the present invention are described hereinafter. The cover is adapted to all kinds of container regardless of types and sizes thereof, as long as the cover is larger than the opening of the container. Vacuum sealing: slightly push down the flexible film 2 of the cover softly to squeeze the air out of the container from the rim thereof, the flexible film 2 and the container are sealed by vacuum. Vacuum releasing: to press the handle 13 by the thumb while pressing the extending portion 23 of the flexible film 2, i.e. the vacuum releasing element, the air is able to enter into the container by pulling the extending portion 23 so as to release the vacuum and remove the cover.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A preservation container cover for a container, comprising:

a flexible film for contacting with a rim of the container, wherein said flexible film has a periphery portion;

an upper sealing ring having a ring slot wherein said periphery portion of said flexible film is extended along said ring slot; and a lower sealing ring equipped with said upper sealing ring to form a clamp structure to affix said periphery portion of said flexible film in said ring slot, wherein said upper sealing ring comprises an inner block ring and an outer block ring constructed to form a clamp ring having an opening facing downward and a "U" shape cross section, wherein said inner block ring comprises an inner wall and a press surface, and an inner expanding ring comprises a shoulder corresponding to said press surface of said inner block ring, wherein said lower sealing ring comprises the inner expanding ring and an outer expanding ring constructed to form an expanding ring having an opening facing upward and a "U" shape cross section, wherein said opening of said clamp ring and said opening of said expanding ring are facing each other and coupled by clamping and expanding to affix said periphery portion of said flexible film; wherein said shoulder further comprises a conical ring integrally extended from said shoulder, wherein said conical ring is plugged into an inner wall of said inner block ring, wherein said shoulder and said press surface provide a vertical pressure to said periphery portion of said flexible film, wherein said outer expanding ring comprises a conical expander, having a terminal, corresponding to said inner wall of said outer block ring, wherein said conical expander provides an outer tilt pressure to said periphery portion of said flexible film; wherein said outer block ring comprises an inner wall and a loop formed on said inner wall, wherein said loop limits a position of said terminal of said conical expander of said outer expanding ring when said outer expanding ring is plugged into said opening of said clamp ring for preventing said outer expanding ring being detached therefrom, wherein said upper ring comprises a handle which further comprises a date indicator for indicating a preservation period.

2. The preservation container cover, as recited in claim 1, wherein said flexible film comprises an extension portion extending beyond the rim of the container outwardly to form a vacuum releasing element for detaching said flexible film from the rim of the container.

* * * * *